US006909264B2

(12) United States Patent
Del Gatto et al.

(10) Patent No.: US 6,909,264 B2
(45) Date of Patent: Jun. 21, 2005

(54) VOLTAGE REGULATOR WITH VERY QUICK RESPONSE

(75) Inventors: Nicola Del Gatto, Torre Del Greco (IT); Vincenzo Dima, Monza (IT); Carla Poidomani, Cassina De' Pecchi (IT); Carmelo Chiavetta, Palermo (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 101 days.

(21) Appl. No.: 10/608,998

(22) Filed: Jun. 26, 2003

(65) Prior Publication Data

US 2004/0075422 A1 Apr. 22, 2004

(30) Foreign Application Priority Data

Jun. 28, 2002 (IT) ..... TO2002A00566

(51) Int. Cl.[7] ..... G05F 1/59
(52) U.S. Cl. ..... 323/268; 323/315; 363/60
(58) Field of Search ..... 323/222, 266, 323/268, 269, 273, 313, 314, 315, 349, 350; 363/59, 60

(56) References Cited

U.S. PATENT DOCUMENTS 5,525,895 A * 6/1996 Fishman ..... 323/268
6,424,128 B1 * 7/2002 Hiraki et al. ..... 323/268
6,636,023 B1 * 10/2003 Amin ..... 323/268
6,654,264 B2 * 11/2003 Rose ..... 363/65
6,661,210 B2 * 12/2003 Kimball et al. ..... 323/268

* cited by examiner

*Primary Examiner*—Jeffrey Sterrett
(74) *Attorney, Agent, or Firm*—Lisa K. Jorgenson; Robert Iannucci; Seed IP Law Group PLLC

(57) ABSTRACT

A voltage regulator with quick response includes: an output terminal supplying a regulated voltage; and at least a first boost circuit, controlled for alternately accumulating a first charge in a first operating condition and supplying the first charge to the output terminal in a second operating condition. In addition, the first boost circuit is provided with a compensation stage supplying the output terminal with a second charge substantially equal to the first charge, when the first boost circuit is in the first operating condition.

31 Claims, 3 Drawing Sheets

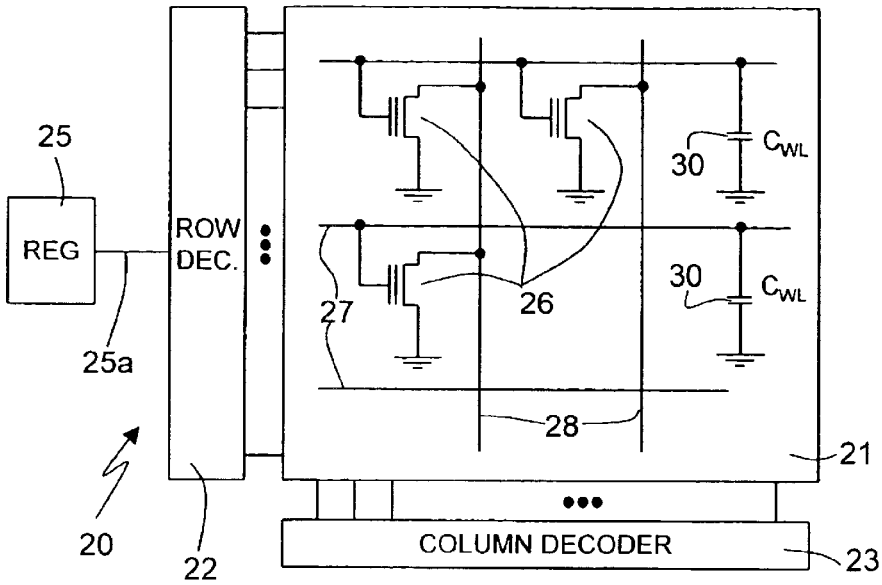
Fig.2
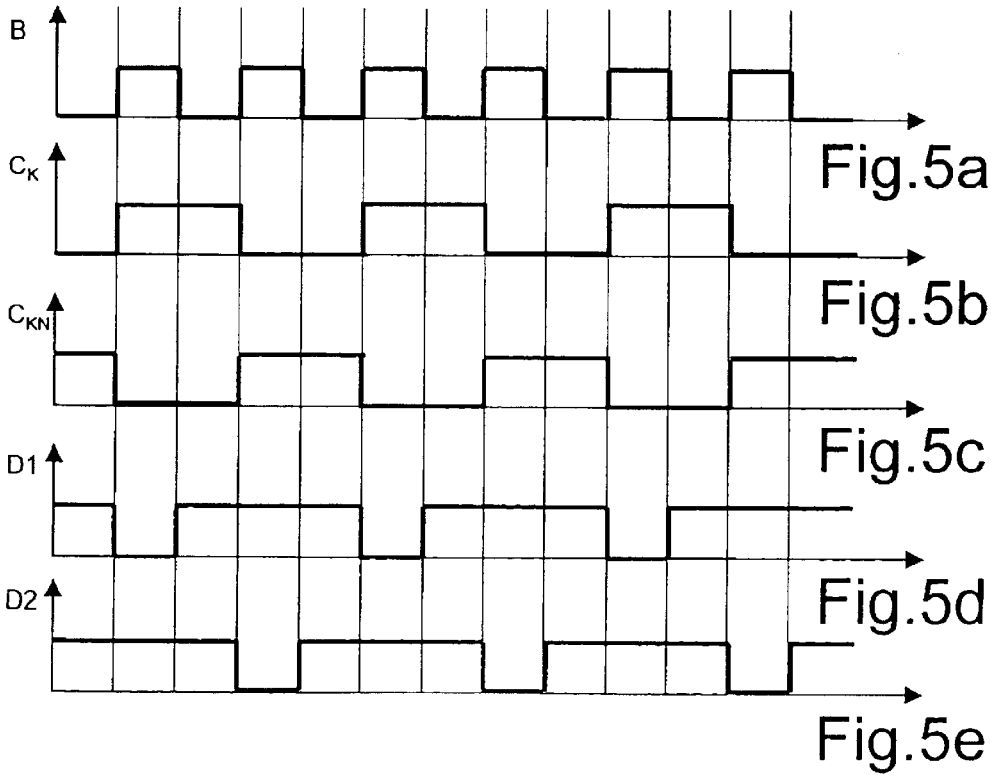

VOLTAGE REGULATOR WITH VERY QUICK RESPONSE

BACKGROUND OF THE INVENTION

1. Field of the Invention

The present invention relates to a voltage regulator with very quick response.

2. Description of the Related Art

As is known, the response time of a voltage regulator depends upon various factors, amongst which are the dimensions of the capacitances connected to the node to be regulated and the maximum current delivered by the regulator. Clearly, the stability of the voltage on the node to be regulated is affected by the response time of the regulator. Following upon a disturbance, in fact, the charge accumulated on the capacitances connected to the node to be regulated is modified, and the voltage returns to the nominal value only when the regulator has restored that charge. In practice, the voltage on the node to be regulated is never rigorously constant, but has oscillations around the nominal value (i.e., ripple). The regulator has to reduce the amplitude of this ripple and attenuate it as fast as possible.

Furthermore, some regulated circuits have an impulsive type behavior, which is critical for the regulator. In particular, when some of the load capacitances can be selectively connected to the regulator through switches, closing of these switches causes a sudden absorption of very high currents, as said in an impulsive way. This situation arises, for example, in case of voltage regulators for reading/writing memory arrays, especially ones of a non-volatile type. It is in fact known that a memory array comprises a plurality of cells organized in rows and columns; cells belonging to a same row have gate terminals connected to a same wordline, while cells belonging to a same column have drain terminals connected to a same bitline. High capacitances are hence associated with each wordline and bitline. In particular, when a cell is selected for reading/writing, the corresponding wordline is connected to a voltage regulator through one or more switches, and the associated capacitance absorbs an impulsive current.

Normally, to reduce the ripple of the regulated voltage a buffer capacitor is used, which is connected directly to the output of the regulator, upstream of the switches. The buffer capacitor may be an independent component arranged at the output of the regulator or, alternatively, a part of the capacitive load stably connected to the output of the regulator. Upon closing of the switches, the charge stored on the buffer capacitor is shared with the load capacitances, and thus the variation of the regulated voltage depends upon the ratio between the capacitance of the buffer capacitor and the total capacitance connected in parallel to the output of the regulator, i.e., the sum of the capacitance of the buffer capacitor and the capacitance of the load capacitor: in particular, the greater the capacitance of the buffer capacitor, the smaller the ripple of the regulated voltage. On the other hand, the time employed by the regulator for restoring the charge on the buffer capacitor increases as its capacitance increases. In practice, then, the need to reduce the ripple is in contrast with the requirement of quick response, and it is not possible to reach optimal compromises.

In order to overcome this drawback, voltage regulators having a boost stage have been proposed. For greater clarity, see FIG. 1, wherein a voltage regulator 1 is illustrated, which comprises a differential amplifier 2, a control unit 4, and a boost circuit 5. FIG. 1 further illustrates a a buffer capacitance $C_T$, here represented by a buffer capacitor 3 statically connected to an output terminal 1*a* of the regulator 1, and a load circuit 6 that includes a switched capacitance $C_L$, here illustrated schematically by means of a load capacitor 7, which can be selectively connected to the output terminal 1*a* through a switch 8. in practice, there is therefore a fixed capacitive component and a variable capacitive component, i.e., the buffer capacitance $C_T$ and, respectively, the switched capacitance $C_L$. The fixed component is constantly connected to the output terminal 1*a* of the regulator 1, while the variable component is set in parallel to the fixed component only following upon closing of the switch 8.

The differential amplifier 2 has an inverting input connected to a reference-voltage source 10, which supplies a constant band-gap voltage $V_{BG}$, an inverting input connected to an intermediate node 11 of a resistance divider 12, and an output, which is connected to the output terminal 1*a* and which supplies a regulated voltage $V_R$. Furthermore, the resistance divider 12 is connected between the output terminal 1*a* and ground in parallel to the buffer capacitor 3.

The boost circuit 5 comprises a drive stage 14 and a boost capacitor 15, which has a boost capacitance $C_B$. The drive stage 14, here a CMOS inverter comprising an NMOS transistor 17 and a PMOS transistor 18, has an input 14*a* receiving a boost signal B of a logic type generated by the control unit 4, and an output connected to a first terminal 15*a* of the boost capacitor 15. In addition, the drive stage 14 has a first supply terminal, connected to a voltage-boosted line 16, which supplies a boosted voltage $V_A$ higher than the regulated voltage $V_R$, and a second supply terminal connected to ground. In particular, the NMOS transistor 17 and PMOS transistor 18 have gate terminals connected to the input 14*a* and drain terminals connected to the output and, thus, to the first terminal 15*a* of the boost capacitor 15. A second terminal of the boost capacitor 15 is connected to the output terminal 1*a* of the regulator 1.

The boost signal B is synchronized with the switch 8. In particular, when the switch 8 is open, the boost signal B is high; Consequently, the PMOS transistor 18 is off, and the NMOS transistor 17 is on and grounds the first terminal 15*a* of the boost capacitor 15, which accumulates a boost charge $Q_B$. When, instead, the switch 8 is closed, the boost signal B is low; in this case, the NMOS transistor 17 is off, while the PMOS transistor 18 connects the first terminal 15*a* of the boost capacitor 15 to the voltage-boosted line 16. The boost charge $Q_B$, previously accumulated on the boost capacitor 15, is then injected into the output terminal 1*a* and absorbed by the load circuit 6. It is possible to size the boost capacitor 15 and the value of the boosted voltage $V_A$ so that the boost charge $Q_B$ injected into the output terminal 1*a* ($Q_B=C_BV_A$) is substantially equal to the charge absorbed by the load circuit 6. In this way, the ripple of the regulated voltage $V_R$ is considerably reduced.

However, the known regulators have some limitations. In fact, after the boost capacitor 15 has been discharged, it must again absorb the boost charge $Q_B$, when its first terminal 15*a* is grounded. Thus, a condition arises which is altogether similar to the sudden absorption of current by the load circuit 6, and hence the regulated voltage $V_R$ is subject to ripple. To prevent this ripple, the drive circuit 14 that takes the first terminal 15*a* of the boost capacitor 15 from the boosted voltage $V_A$ to ground is usually switched gradually. It is clear that, in this way, the transition is also slower. Consequently, the regulator 1 is not suited for being used at high frequencies, as, instead, is required increasingly more frequently in numerous applications.

BRIEF SUMMARY OF THE INVENTION

An embodiment of the present invention provides a voltage regulator free from of the described drawbacks.

An embodiment of the invention provides a voltage regulator with quick response, which includes: an output terminal supplying a regulated voltage; and a first boost circuit. The boost circuit is controlled for alternately accumulating a first charge in a first operating condition and supplying the first charge to the output terminal in a second operating condition. The first boost circuit includes a compensation stage feeding said output terminal with a second charge substantially equal to the first charge when the first boost circuit is in the first operating condition.

BRIEF DESCRIPTION OF THE SEVERAL VIEWS OF THE DRAWING(S)

For a better understanding of the invention, some embodiments thereof are now described, purely by way of non-limiting example and with reference to the attached drawings, wherein:

FIG. 2 illustrates a block diagram of a storage device incorporating a regulator according to the present invention;

FIGS. 5A–5E are graphs showing time plots of quantities present in the voltage regulator of FIG. 4.

DETAILED DESCRIPTION OF THE INVENTION

Figure 1:
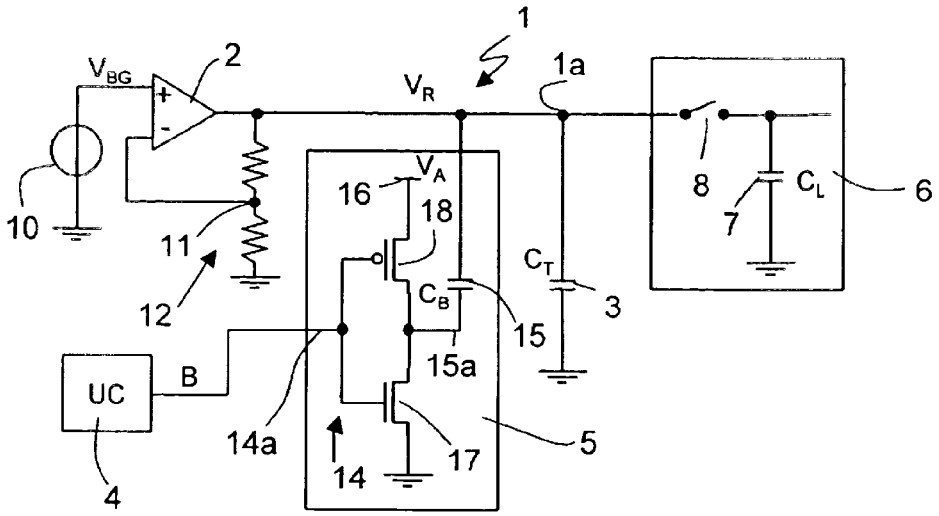
Fig.1 (PRIOR ART)
FIG. 1 illustrates a simplified circuit diagram of a known voltage regulator.

The invention will be illustrated hereinafter with reference to the field of nonvolatile memories. This must not, however, be considered in any sense limiting, since the voltage regulator according to the invention may be advantageously used in various fields, in particular when it is necessary to supply a regulated voltage to a load circuit that substantially absorbs current pulses.

FIG. 2 shows a storage device 20 comprising a memory array 21, here of nonvolatile type, a row decoder 22, a column decoder 23, and a voltage regulator 25. The memory array 21 is formed by a plurality of cells 26 organized in rows and columns. In particular, cells 26 belonging to a same row have gate terminals connected to a same wordline 27, while cells belonging to a same column have drain terminals connected to a same bitline 28. Furthermore, a word capacitance $C_{WL}$, here schematically represented by a word capacitor 30, is associated with each wordline 27.

The row decoder 22 selects one of the wordlines 27 and connects it to an output terminal 25*a* of the voltage regulator 25.

Figure 3:
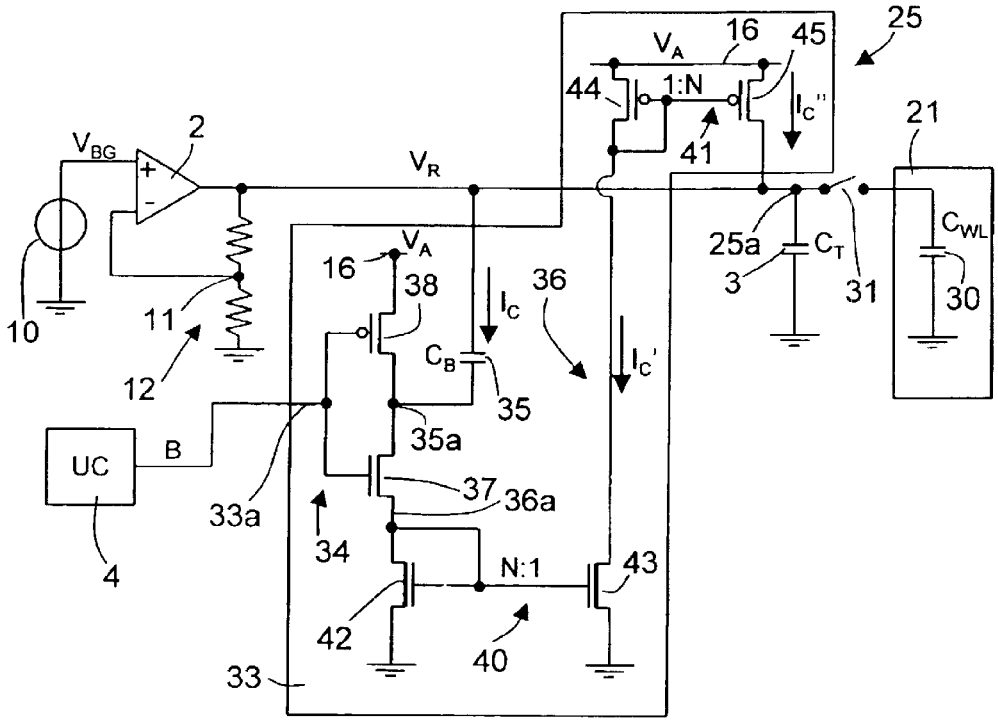
FIG. 3 is a simplified circuit diagram of a voltage regulator according to a first embodiment of the invention.

In FIG. 3, in which parts in common with FIG. 1 are designated by the same reference numbers, the wordline 27 selected and the row decoder 22 are represented schematically by the word capacitors 30 and, respectively, by a switch 31 which selectively connects the word capacitor 30 to the voltage regulator 25. FIG. 3 also illustrates the buffer capacitor 3, which represents a portion of the load of the memory array 21 and/or of the row decoder 22 statically connected to the output terminal 25*a* of the regulator 25.

The regulator 25 comprises the differential amplifier 2, the reference-voltage source 10, the resistance divider 12, and the control unit 4, and is moreover provided with a boost circuit 33. In greater detail, the boost circuit 33 comprises a drive stage 34, a boost capacitor 35, having a boost capacitance $C_B$, and a compensation stage 36.

The drive stage 34 has an input, which forms a control terminal 33*a* of the boost circuit 33 and receives the boost signal B, and an output connected to a first terminal 35*a* of the boost capacitor 35. The boost capacitor 35 has a second terminal connected to the output terminal 25*a* of the voltage regulator 25. In addition, a first supply terminal of the drive stage 34 is connected to the voltage-boosted line 16 and a second supply terminal of the drive stage 34 is connected to an input 36*a* of the compensation stage 36. In greater detail, the drive stage 34 comprises a first drive transistor 37, of NMOS type, and a second drive transistor 38, of PMOS type. The drive transistors 37, 38 have respective gate terminals connected to the control terminal 33*a* and drain terminals connected to the first terminal of the boost capacitor 35. In addition, the source terminals of the first and second drive transistors 37, 38 form the second supply terminal and, respectively, the first supply terminal of the drive stage 34.

The compensation stage 36 has an output connected to the output terminal 25*a* of the voltage regulator 25 and comprises a current sensor 40 and a current source 41, which is controlled by the current sensor 40. In particular, the current sensor 40 and the current source 41 are formed by a first and a second current-mirror circuit, which are connected in cascade together and preferably have a reciprocal mirroring ratio. In greater detail, the current sensor 40 is a current-mirror circuit with a mirror ratio N:1, where N is an integer, and comprises a first current-mirror transistor 42 and a second current-mirror transistor 43, preferably of natural NMOS type. The first and second current-mirror transistors 42, 43 have gate terminals connected to each other common and grounded source terminals. Moreover, the gate and drain terminals of the first current-mirror transistor 42 are directly connected to each other and form the input 36*a* of the compensation circuit 36. The current source 41 is a current-mirror circuit having a mirroring ratio 1:N and comprises a third current-mirror transistor 44 and a fourth current-mirror transistor 45, both of PMOS type, having gate terminals connected to each other and source terminals connected to the voltage-boosted line 16. The gate and drain terminals of the third current-mirror transistor 44 are connected directly to each other; moreover, the drain terminal of the third current-mirror transistor 44 is connected to the drain terminal of the second current-mirror terminal 43, whereas the drain terminal of the fourth current-mirror transistor 45 defines the output of the compensation stage 36 and is connected to the output terminal 25*a* of the voltage regulator 25.

Operation of the voltage regulator 25 is described hereinafter.

The control unit 4 synchronizes the boost signal B with the switch 31 and controls the drive transistors 37, 38 in phase opposition. In particular, when the switch 31 is open, the boost signal B is high: in this case, the first drive transistor 37 is on, while the second drive transistor 38 is off. Consequently, the first terminal 35*a* of the boost capacitor 35 is grounded and accumulates a boost charge $Q_B$ (the threshold voltage of the current-mirror transistors 42, 43, of natural NMOS type, is negligible). When, instead, the switch 31 is closed, so as to connect the word capacitor 30 to the voltage regulator 25, the boost signal B is low and the first drive transistor 37 is off, while the second drive transistor 38 is on. The first terminal 35*a* of the boost capacitor 35 is thus brought to the boosted voltage $V_A$, and the previously accumulated boost charge $Q_B$ is injected into the output terminal 25*a* of the voltage regulator 25 to compensate for the absorption of current by the word capacitor 30. In these conditions, the boost capacitor 35 is discharged and consequently, when the boost signal B switches again to the high level, draws a recharge current $I_c$ from the output terminal 25*a* of the regulator 25. The recharge current $I_c$ flows through the first drive transistor 37, which is on, and through the first current-mirror transistor 42, and is then detected by the current sensor 40. Since the current sensor 40 is a current-mirror circuit with a mirroring ratio N:1, the second current-mirror transistor 43 conducts a mirrored current $I_c'$ equal to $I_c/N$. The mirrored current $I_c'$ moreover flows through the third current-mirror transistor 44 and is used for controlling the current source 41. In fact, also the current source 41 is a current-mirror circuit, having a mirroring ratio 1:N, so that the fourth current-mirror transistor 45 is on and feeds the output terminal 25*a* with a compensation current $I_c''$, which, at each instant, is substantially N times greater than the mirrored current $I_c'$ and, consequently, is equal to the recharge current $I_c$; in other words, we have:

$$I_c''=N*I_c'=N*(1/N)*I_c=I_c.$$

In this way, the recharge current $I_c$ and the compensation current $I_c''$ are the same, while the mirrored current $I_c'$ is much lower.

In practice, during charging, the current sensor 40 is connected in series to the boost capacitor 35 and detects the recharge current $I_c$ that the boost capacitor 35 absorbs from the output terminal 25*a* of the voltage regulator 25 for restoring the boost charge $Q_B$. The current source 41 is controlled by the current sensor 40 so as to supply the output terminal 25*a* with the compensation current $I_c''$ equal to the recharge current $I_c$ or, in other words, a compensation charge $Q_c$ equal to the boost charge $Q_B$ to be restored. In order to generate the compensation current $I_c''$, in fact, the recharge current $I_c$ is mirrored twice, first by the current sensor 40 and then by the current source 41, which have reciprocal mirroring ratios. Consequently, the current necessary for restoring the boost charge $Q_B$ on the boost capacitor 35 is substantially supplied by the current source 41.

In this way, the ripple of the regulated voltage $V_R$ due to the recharging of the boost capacitor 35 is advantageously eliminated. In fact, to restore the boost charge $Q_B$ it is not necessary to take the charge accumulated on the buffer capacitor 3, and hence the regulated voltage $V_R$ remains stable. In addition, given that the boost circuit 33 can supply compensation currents $I_c'$ that are even very high, the boost charge $Q_B$ can be restored rapidly. Consequently, the voltage regulator is suitable for being used for high-frequency applications. Moreover, advantageously, the current-mirror circuits, which form the current sensor 40 and the current source 41, have a reciprocal mirroring ratio. In this way, in fact, the mirrored current $I_c'$ is much lower than the recharge current $I_c$ and than the compensation current $I_c''$, and hence the dissipated power is negligible.

Figure 4:
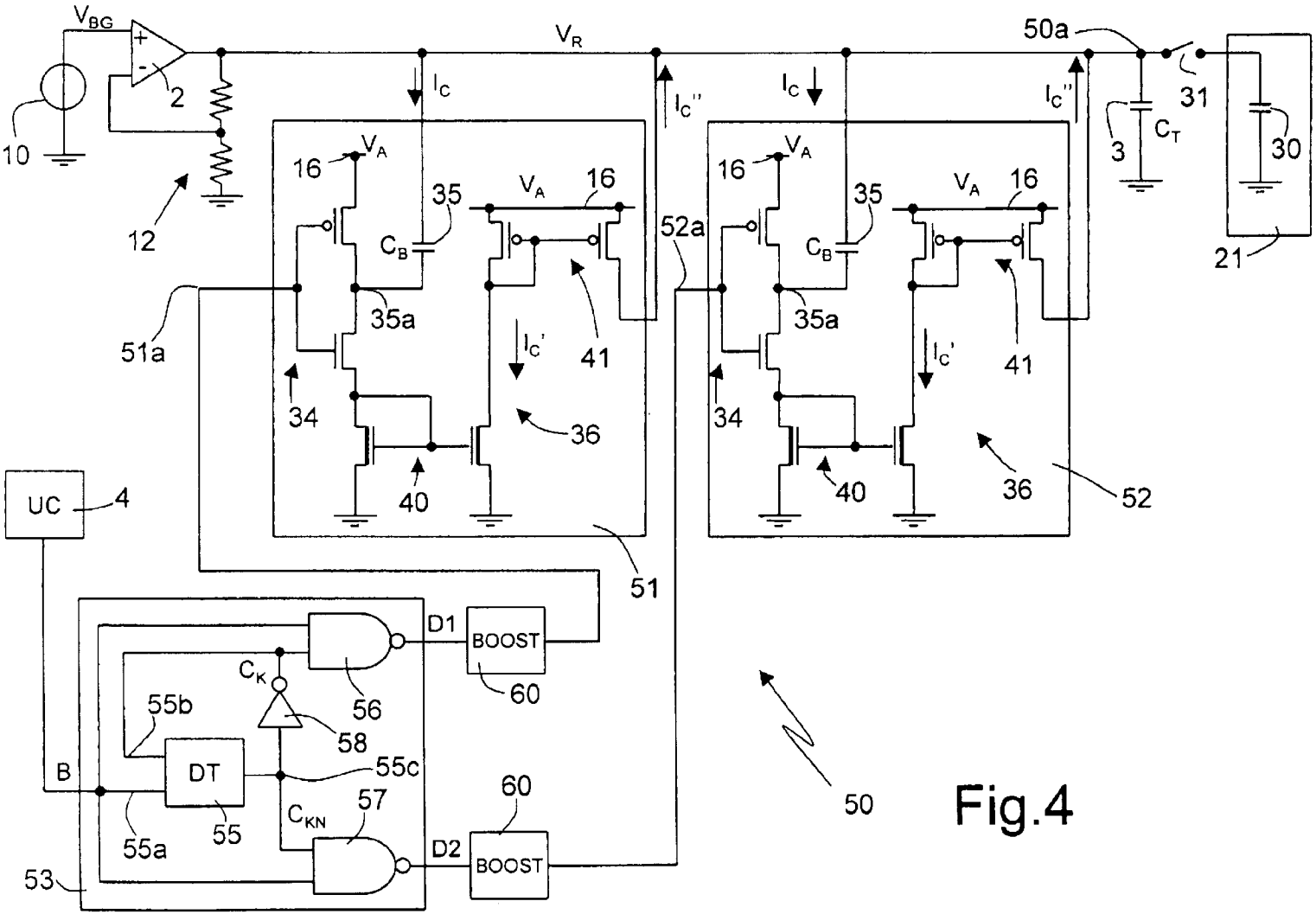
FIG. 4 is a simplified circuit diagram of a voltage regulator in a second embodiment of the present invention.

According to a different embodiment of the invention, illustrated in FIG. 4, a voltage regulator 50 having an output terminal 50*a* comprises the differential amplifier 2, the reference-voltage source 10, the resistance divider 12, and the control unit 4, and is moreover provided with a first boost circuit 51 and a second boost circuit 52, as well as a timing circuit 53. Both of the boost circuits 51, 52 have the same structure as the boost circuit 33 illustrated in FIG. 3. In particular, the boost circuits 51, 52 each comprise a respective drive stage 34, a respective boost capacitor 35, and a respective compensation stage 36, which in turn comprises a current sensor 40 and a current source 41, which is controlled by the current sensor 40. As already described previously, the current sensor 40 and the current source 41 comprise respective current-mirror circuits cascade-connected. Moreover, the current sensor 40 of each of the boost circuits 51, 52 can be selectively series-connected to the respective boost capacitor 35. The first boost circuit 51 and the second boost circuit 52 have control terminals 51*a*, 52*a* formed by the inputs of the respective drive stages 34.

The timing circuit 53 comprises a flip-flop 55, of DT type, a first NAND gate 56 and a second NAND gate 57. In greater detail, the flip-flop 55 has a timing input 55*a* connected to the control unit 4 and receiving the timing signal B, a data input 55*b*, and an output 55*c*. The output 55*c* of the flip-flop 55 is connected to the data input 55*b* through an inverter 58. In this way, in practice, the flip-flop 55 switches at each leading edge of the boost signal B. The first and second NAND gates 56, 57 have first inputs connected to the control unit 4 and receiving the boost signal B and second inputs connected to the output of the inverter 58 and, respectively, to the output 55*c* of the flip-flop 55. Consequently, on the second inputs of the first and second NAND gates 56, 57 a timing signal CK and, respectively, a inverted timing signal CKN are present, which have a period twice that of the boost signal B and are in phase opposition with respect to one another (see FIGS. 5*a*–5*c*). In addition, outputs of the first and second NAND gates 56, 57 are connected to control terminals 51*a*, 52*a*, respectively, of the first boost circuit 51 and of the second boost circuit 52 and supply a first drive signal D1 and, respectively, a second drive signal D2 (see FIGS. 5*d* and 5*e*). Preferably, respective voltage-boost stages 60 are arranged in series to the outputs of the NAND gates 56, 57 to ensure that the drive signals D1, D2 will have voltage levels sufficient for controlling the drive stages 34 of the boost circuits 51, 52 (these levels being at least equal to the boosted voltage $V_A$). In this way, the NAND gates 56, 57 can be supplied with a standard supply voltage, lower than the boosted voltage $V_A$.

As described previously with reference to the FIG. 3, the control unit 4 synchronizes the boost signal B with the switch 31. When the boost signal B is low (switch 31 closed), the NAND gates 56, 57 are blocked, and hence the drive signals D1, D2 are maintained at high level (see FIGS. 5*a*, 5*d*, 5*e*). In this condition, the boost capacitor 35 of both boost circuits 51, 52 have respective first terminals 35*a* connected to ground and are recharged. When, instead, the boost signal B is high, the NAND gates 56, 57 can switch. Since the timing signals CK, CKN are in phase opposition with respect to one another, at each cycle of the boost signal B alternately one of the NAND gates 56, 57 switches, whereas the other remains blocked. At each cycle of the boost signal B alternately one of the drive signals D1, D2 switches to the low value, activating the respective one of the boost circuits 51, 52, while the other remains high. As explained with reference to FIG. 3, the boost circuits 51, 52 transfer to the output terminal 50*a* and thus to the word capacitor 30 the charge accumulated on the respective boost capacitors 35, when the respective drive signal D1, D2 is low, and are recharged otherwise. In practice, then, the boost circuits 51, 52 are controlled in phase opposition, because the drive signals D1, D2 have a phase difference of one half-period. Furthermore, each boost circuit 51, 52 can continue recharging its own boost capacitor 35 whereas the other supplies the charge necessary for compensating current absorption by of the word capacitor 30.

It is therefore clear that the possibility of alternately operating the first and the second boost circuit 51, 52 enables voltage regulators to be obtained with extremely quick response, without jeopardizing the stability of the regulated voltage $V_R$. In addition, the better performance may be obtained with a modest increase in overall dimensions.

Finally, it is evident that modifications and variations can be made to the voltage regulator described herein, without thereby departing from the scope of the present invention.

In particular, the invention may be advantageously used also for applications other than the regulation of the read/write voltages of non-volatile memories and especially when it is necessary to supply a regulated voltage with precision to a load that absorbs current in an impulsive way.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

What is claimed is:

1. A voltage regulator with quick response, comprising:

an output terminal, supplying a regulated voltage; and a first boost circuit, which is controlled for alternately accumulating a first charge in a first operating condition and supplying said first charge to said output terminal in a second operating condition; wherein said first boost circuit comprises a compensation stage feeding said output terminal with a second charge substantially equal to said first charge when said first boost circuit is in said first operating condition.

2. The regulator according to claim 1 wherein said compensation stage comprises a controlled current-source circuit connected to said output terminal and supplying said second charge in said first operating condition.

3. The regulator according to claim 2 wherein said compensation stage comprises a current-sensor circuit, which is selectively connected to said output terminal in said first operating condition.

4. The regulator according to claim 3 wherein said controlled current-source circuit is controlled by said current-sensor circuit.

5. The regulator according to claim 4 wherein said current-sensor circuit is configured to be traversed by a first current absorbed by said first boost circuit in said first operating condition and in that said controlled current-source circuit is controlled so as to supply to said output terminal a second current equal to said first current.

6. The regulator according to claim 4 wherein said current-sensor circuit and said controlled current-source circuit comprise a first and, respectively, a second current-mirror circuit cascade-connected.

7. The regulator according to claim 6 wherein said current-sensor circuit and said controlled current-source circuit have a reciprocal mirroring ratio.

8. The regulator according to claim 7 wherein said first boost circuit has a control terminal receiving a control signal having a first logic value in said first operating condition, and a second logic value in said second operating condition.

9. The regulator according to claim 7 wherein said first boost circuit comprises a capacitive element.

10. The regulator according to claim 9 wherein said first boost circuit comprises a supply line, which supplies a supply voltage greater than said regulated voltage, and said capacitive element has a first terminal, selectively connected to a reference-potential line in said first operating condition, and to said supply line in said second operating condition; and a second terminal connected to said output terminal.

11. The regulator according to claim 9 wherein said current-sensor circuit comprises a first current-mirror transistor and a second current-mirror transistor, which have gate terminals connected to each other and respective source terminals connected to said reference-potential line, said first current-mirror transistor having a drain terminal connected to said gate terminals and being selectively connected to said first terminal of said capacitive element in said first operating condition.

12. The regulator according to claim 11 wherein said controlled current-source circuit comprises a third current-mirror transistor and a fourth current-mirror transistor, which have gate terminals connected to each other and source terminals connected to said supply line, said third current-mirror transistor having a drain terminal connected to said gate terminals and said fourth current-mirror transistor having a drain terminal connected to said output terminal.

13. The regulator according to claim 11 wherein said first boost circuit comprises a drive stage having a first supply terminal connected to said supply line and a second supply terminal connected to the drain terminal of said first current-mirror transistor; an input forming said control terminal; and an output selectively connected to said first supply terminal in said second operating condition, and to said second supply terminal in said first operating condition.

14. The regulator according to claim 13 wherein said first terminal of said capacitive element is connected to said output of said drive stage.

15. The regulator according to claim 1, further comprising a second boost circuit connected in parallel to said first boost circuit.

16. The regulator according to claim 15 wherein said first and second boost circuits have the same structure and are controlled in phase opposition.

17. The regulator according to claim 15, further comprising a timing circuit associated with said first boost circuit and said second boost circuit and supplying respective drive signals in phase opposition to each other.

18. A regulated electronic device, comprising:

a load circuit; and a voltage regulator supplying a regulated voltage, and be selectively connected to the load circuit, said voltage regulator including:

an output terminal, supplying a regulated voltage; and a first boost circuit, which is controlled for alternately accumulating a first charge in a first operating condition and supplying said first charge to said output terminal in a second operating condition; wherein said first boost circuit comprises a compensation stage feeding said output terminal with a second charge substantially equal to said first charge when said first boost circuit is in said first operating condition.

19. The device according to claim 18, further comprising control unit connected to said voltage regulator to control said first boost circuit in said first operating condition when said load circuit is disconnected from said voltage regulator and in said second operating condition when said load circuit is connected to said voltage regulator.

20. The device according to claim 18 or 19 wherein said load circuit is a non-volatile memory array and said regulated voltage is a read/write voltage.

21. A method for regulating a voltage on a terminal selectively connected to a load, comprising the steps of:

accumulating a first charge, when said terminal is disconnected from said load; and injecting said first charge into said terminal, when said terminal is connected to said load;

wherein said step of accumulating comprises supplying said terminal with a second charge equal to said first charge.

22. The method according to claim 21 wherein said step of accumulating comprises absorbing a first current from said terminal.

23. The method according to claim 22 further comprising the step of measuring said first current.

24. The method according to claim 22 wherein said step of supplying a second charge comprises supplying a second current equal to said first current.

25. The method according to claim 24 wherein said step of supplying a second current comprises mirroring said first current.

26. The method according to claim 21 wherein said step of supplying said second charge comprises taking said second charge from a supply line arranged at a supply voltage higher than said voltage on said terminal.

27. A regulating electronic device, comprising:

a load;

a regulating terminal selectively connected to the load;

means for accumulating a first charge, when the terminal is disconnected from the load; and means for injecting the first charge into the terminal, when the terminal is connected to the load;

wherein the accumulating means includes means for supplying the terminal with a second charge equal to the first charge when the terminal is disconnected from the load.

28. The device of claim 27 wherein the accumulating means absorbs a first current from the terminal.

29. The device of claim 28 wherein the supplying means supplies to the terminal a second current equal to the first current.

30. The device of claim 28 wherein the supplying means include a first current mirror that mirrors the first current to produce a second current that the supplying means supplies to the terminal.

31. The device of claim 28, wherein the supplying means include:

a first current mirror that mirrors the first current to produce a second current, the first current mirror having a mirror ratio of N:1; and a second current mirror that mirrors the second current to produce a third current, the second current mirror having a mirror ratio of 1:N and supplying the third current to the terminal when the terminal is disconnected from the load.

* * * * *